United States Patent [19]

Muse et al.

[11] 4,393,931

[45] Jul. 19, 1983

[54] COMBINATION HYDRAULICALLY SET HANGER ASSEMBLY WITH EXPANSION JOINT

[75] Inventors: John F. Muse; Rudy B. Callihan; Bobby F. Goad, all of San Antonio; Clyde S. Wainwright, Jr., McQueeney, all of Tex.

[73] Assignee: Baker International Corporation, Orange, Calif.

[21] Appl. No.: 257,839

[22] Filed: Apr. 27, 1981

[51] Int. Cl.[3] ..... E21B 19/10

[52] U.S. Cl. ..... 166/208; 166/212; 175/322

[58] Field of Search ..... 166/208, 212, 121, 216, 166/217, 124, 206; 175/321, 322

[56] References Cited

U.S. PATENT DOCUMENTS

| | | | |
|---|---|---|---|
| 3,399,548 | 9/1968 | Burns | 175/321 |
| 3,677,341 | 7/1972 | Burns et al. | 166/124 |
| 3,934,652 | 1/1976 | Cochran | 166/285 |
| 4,096,913 | 6/1978 | Kenneday et al. | 166/208 |
| 4,287,949 | 9/1981 | Lindsey, Jr. | 166/212 |

*Primary Examiner*—William F. Pate, III
*Assistant Examiner*—William P. Neuder
*Attorney, Agent, or Firm*—William C. Norvell, Jr.

[57] ABSTRACT

The disclosure relates to an improved apparatus for effecting the cementing of a liner at the bottom of a well bore. The liner sleeve assembly is inserted into the well bore on a hanger which is detachably connected to a running tool, which, in turn is connected to the work string by a torque transmitting expansion joint. The running tool may be fluid pressure actuated to set the hanger. In the event of failure of the fluid pressure setting operation, the hanger may be mechanically set by rotation of the work string transmitted to the running tool by the torque transmitting expansion joint.

5 Claims, 12 Drawing Figures

COMBINATION HYDRAULICALLY SET HANGER ASSEMBLY WITH EXPANSION JOINT

BACKGROUND OF THE INVENTION

1. Field of the Invention

This invention relates to apparatus for effecting the cementing of a liner at the bottom of a well bore by the suspension of the liner from a liner hanger which is engaged with the bottom portions of the well casing through the hydraulic actuation of a running tool which is connected to the work string by a torque transmitting expansion joint.

2. Description of the Prior Art

The cementing of a tubular liner assembly in that portion of the well bore extending downwardly beyond the well casing is an expedient that has been long practiced in the drilling art. It is the common practice to suspend the liner assembly from a hanger which has slips that are expanded to engage the interior bore of the lower end of the well casing. The setting of the hanger anchor is normally accomplished by a running tool which also effects the running-in of the liner assembly and the hanger.

In the past, many hangers have been mechanically actuated to achieve their setting. This necessarily requires mechanical manipulation of the running-in tool by the tubular work string from which it is suspended. For example, see the cementing apparatus disclosed in U.S. Pat. No. 4,060,131 to Kenneday et al.

With modern wells extending to ever increasing depths and often involving directional drilling, the reliability of mechanical setting of the hanger has been adversely affected. Modern drillers may sometimes prefer to employ hydraulically actuated running tools to effect the setting of hangers for cementing operations. At the same time, however, any such hanger and running tool should be capable of mechanical setting in the event that the hydraulic setting system should fail for any unforeseen reason. Prior art hydraulically actuated running tools have not had the capability of transmitting torque through the tool in order to effect such mechanical setting operation. There is, therefore, a definite need for an improved well cementing apparatus, capable of either hydraulic or mechanical setting of the hanger through the utilization of economical, readily available components.

SUMMARY OF THE INVENTION

The invention provides a well cementing apparatus incorporating a conventional liner assembly, including at its lower end a cement float shoe, and being connected at its upper end to a hanger having expansible slips. A landing collar is incorporated in the liner assembly at any desired medial position in order to permit fluid sealing of the liner bore in order to permit the development of internal pressures. A hydraulically actuated running tool is conventionally connected to the hanger by left hand square threads for run-in purposes. The running tool in turn is connected to a torque transmitting expansion joint comprising two telescoping sleeve assemblies respectively having threaded members at their outboard ends for respective connection to the running tool and to a tubular work string, sealing means to prevent leakage between the two telescoping sleeves and, most importantly, splined cooperating elements on each sleeve assembly to permit the transmission of torque through the expansion joint.

A cementing apparatus embodying this invention may effect the setting of the hanger either before or after the cementing operation. If setting of the hanger is desired prior to the cementing operation, a ball seat sleeve is shearably connected to the interior of the landing collar provided in the liner assembly. A ball is then dropped onto such sleeve to provide an effective fluid pressure barrier, permitting the interior bore of the liner and communicating bores of the running tool and the expansion joint to be pressurized through the tubular work string. The hydralic running tool incorporates an axially shiftable retaining element which cooperates with spring biased slips of the hanger to hold such slips in a retracted position during run-in. The opposite end of the retaining element defines an annular piston which is disposed in an annular cylinder element defined by the running tool and provided with fluid communication with the bore of the running tool. The application of fluid pressure to such bore first effects the shearing of a shear screw which holds the retaining element in its run-in position and then the fluid pressure acts on the piston end of the retaining element to shift it in a direction to release the slips of the hanger for outward movement under the influence of the pre-compressed spring elements. The hanger is thus hydraulically set.

In order to proceed with the cementing operation, it is necessary to disposed of the ball valve. This is done by increasing the fluid pressure within the bore of the liner assembly to an extent that the shear screws holding the ball valve seat sleeve are sheared and the sleeve and the ball are permitted to drop down the liner assembly. A perforated member is disposed in the liner at a point below the landing collar and captures the ball valve seat sleeve and the ball without interfering with the flow of fluid down through the liner. Cementing fluid may then be introduced to the tubular work string and it will flow freely down through the liner assembly, out through the cement float shoe at the bottom of the liner assembly, and up around the exterior of the liner to anchor the liner in the uncased well bore. When a desired quantity of cementing fluid has been introduced into the well bore, a solid wiper plug is then pushed down through the well bore through the application of the pressure of a fluid such as a drilling mud. In accordance with this invention, all elements through which the cementing fluid flows, including the torque transmitting expansion unit, are formed with essentially the same bore diameter so that a wiping of all surfaces exposed to the cementing fluid is achieved in the single downward passage of the solid wiper plug through the interconnected bores.

If desired, an annular liner wiper plug may be shearably supported on the end of the length of tubing connected to the bottom end of the hydraulic running tool in direct communication with the axial bore of the running tool. When the solid wiper plug engages the annular liner wiper plug, it effects the shearing of the retaining shear pins and pushes the annular liner wiper plug downwardly, effecting a wiping of the interior surface of the liner. The two plugs travel together until the annular liner wiper plug seats on the landing collar and at this point, the solid wiping plug forms an effective fluid seal with the top surface of the annular liner wiper plug. This effectively prevents contamination of the cementing fluid by the drilling mud.

If it is desired to effect the setting of the hanger after the cementing operation, the ball valve is not introduced into the apparatus and the cementing fluid is passed down through the interconnecting bores of the expansion joint, the running tool, the coupling sleeve, the liner wiper plug and the bore of the landing collar into the main bore of the liner assembly. After the required quantity of cementing fluid has been flowed into the liner assembly, the solid wiper plug is introduced into the tubular work string at the top of the well and urged downwardly by the pressure of an appropriate fluid. The solid plug performs the same cement wiping function as heretofore described, then engages the annular liner wiper plug and moves it downwardly into sealing engagement with the landing collar. At this point, the bottom of the interconnected axial bores of the various elements of the apparatus is effectively sealed and the fluid pressure may be increased in order to effect the setting of the hanger.

Finally, in the event that, for some unforeseen reason, it is impossible to achieve hydraulic actuation of the hanger, the hanger may be set in conventional fashion by mechanical manipulation of the work string. In most cases, this requires a right hand turning of the running tool to disengage the running tool from the hanger threads. The torque transmission property of the expansion joint readily permits the mechanical actuation and absorbs the upward movement of the running tool, hence the hanger may be set, even though the hydraulic setting operation could not be accomplished.

DESCRIPTION OF THE PREFERRED EMBODIMENTS

Figure 1:
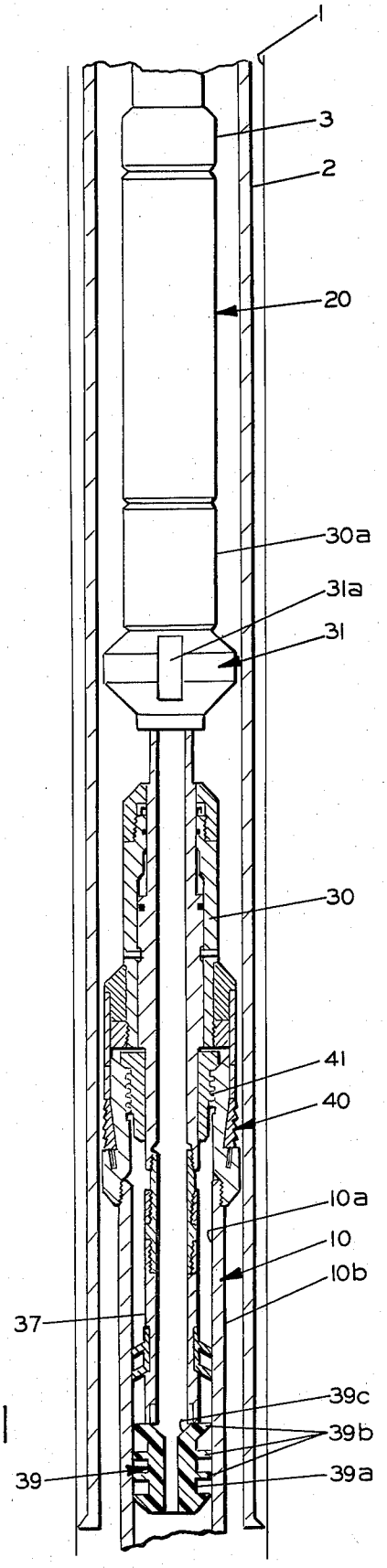
FIGS. 1 and 2 together constitute a vertical sectional view of a well bore containing a liner cementing apparatus constructed in accordance with this invention, with the components thereof shown in their initial run-in position, FIG. 2 being a vertical continuation of FIG. 1.

Referring to FIG. 1, there is shown a well bore 1 having a casing 2 conventionally inserted therein and terminating at a point above the bottom of the well bore.

To effect the cementing of a liner assembly 10 in the bottom of the well bore 1, a cementing tool assembly is assembled at the well head to the end of a tubular work string 3. The elements of the tool, which are rigidly secured to the end of work string 3 for run-in purposes, constitute, in descending order, a torque transmitting, annular expansion joint 20 which is threadably secured at its bottom end to the top end of a hydraulically actuated running tool 30. The running tool 30 is in turn detachably secured to a liner hanger assembly 40 by virtue of a left handed threaded engagement therewith indicated at 41. The lowermost portion of liner hanger 40 is threadably secured to the top portions of the liner sleeve assembly 10. At a medial position in the liner assembly 10, a landing collar sleeve 15 is threadably secured therein. The bottom end of the liner sleeve assembly 10 is conventionally secured to a cement float shoe 50.

Many of the aforementioned components of the cementing apparatus constitute conventional elements. For example, starting at the bottom of the assembly, the cement float shoe 50 may constitute the Bakerline Cement Float Shoe Product No. 100-01, manufactured and sold by Bakerline Division, Baker International Corporation, San Antonio, Tex. The landing collar sleeve 15 may comprise the Bakerline Landing Collar Proudct No. 266-50, also manufactured and sold by Bakerline. The liner hanger assembly 40 may constitute the Bakerline Model "A" Simplex Liner Hanger, Product No. 261-01, manufactured and sold by Bakerline. Accordingly, no detailed description of these well known individual elements will be undertaken, but reference will be made only to the operative components of such conventional elements.

Figure 7:
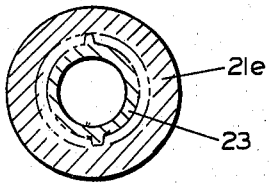
FIG. 7 is a sectional view taken on the plane 7—7 of FIG. 5.
Figure 5:
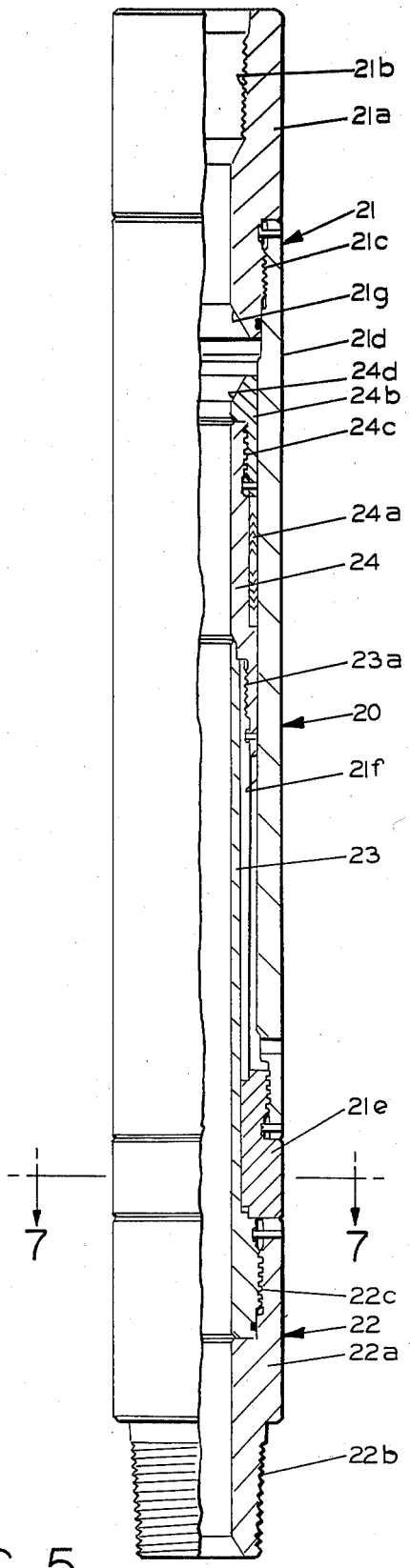
FIG. 5 is a vertical quarter sectional view of a torque transmitting expansion coupling constructed in accordance with this invention with the elements of the coupling shown in their shortest length positions.
Figure 6:
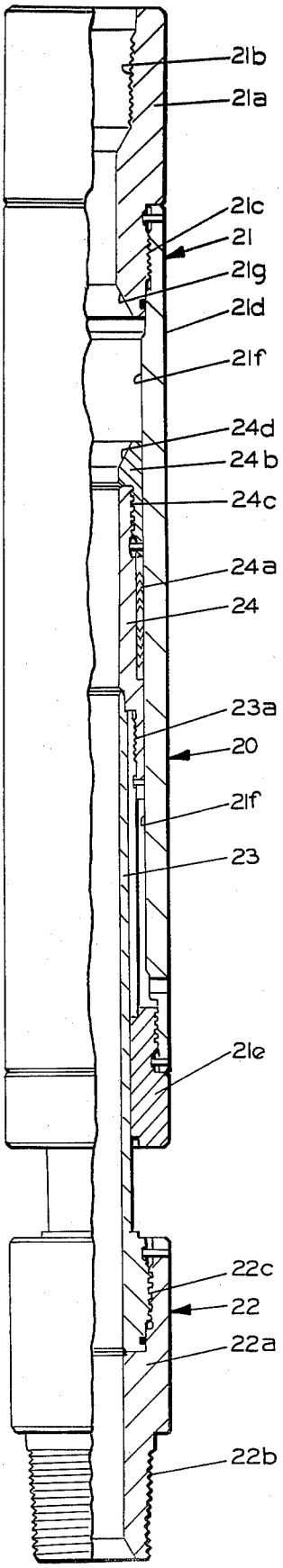
FIG. 6 is a view similar to FIG. 4 but showing the elements of the torque transmitting coupling in an extended position.

The torque transmitting annular expansion joint 20 is shown in detail in FIGS. 5–7. The joint is formed by the assembly of two cooperating sleeve assemblies 21 and 22, respectively. The sleeve assembly 21 includes a coupling sleeve 21*a* having internal threads 21*b* for attachment to the tubular work string 3. The bottom end of coupling sleeve 21*a* is externally threaded as indicated at 21*c* for connection to an outer seal bore sleeve 21*d* which is threadably secured at its bottom end to an internally splined, annular block 21*e*.

The sleeve assembly 22, which is slidably engagable with sleeve assembly 21, comprises a lower coupling element 22*a* having threads 22*b* on its lower portion for connection to the threads of the running tool 30. The top portion of connection sleeve 22*a* is internally threaded as indicated at 22*c* and connected to the bottom end of an inner sleeve element 23 which is externally splined (FIG. 7) to co-operate with the internal splines of the splined block 21*e*. The upper end of the externally splined inner sleeve 23 is threadably secured by threads 23*a* to an annular seal mounting structure 24 which mounts a plurality of annular chevrontype seals 24*a* in conventional fashion for sliding and sealingcooperation with the internal surface 21*f* defined by the outer sleeve element 21*d*. The chevron seal assembly 24*a* is held in position by an internally threaded sleeve 24*b* which is threadably secured as at 24*c* to the upper end of the seal mounting structure 24 and has a tapered internal surface 24*d* for a purpose that will be hereinafter described. In similar fashion, the opposed surface of the coupling sleeve 21*a* is tapered as indicated at 21*g*.

From the foregoing description, it will be apparent that the sleeve assemblies 21 and 22 are capable of relative axial expansion movement as illustrated in FIG. 6.

During such movement, the splined block 21e slides on the exterior of the splined internal sleeve 23 and the chevron seal assembly 24a sealingly engages the bore surface 21f of the outer sleeve 21d, thus maintaining the fluid integrity of the expansion joint 20 in any of its extended positions. At the same time, the torque that is transmitted by the work string 3 will be transmitted through the expansion joint 20 to the running tool 30, which is rigidly secured to the bottom end of such expansion joint. Thus, the running tool 30 may be rotated by the tubing string in either a clockwise or counterclockwise direction after the apparatus has been inserted in the well bore.

Figure 3A:
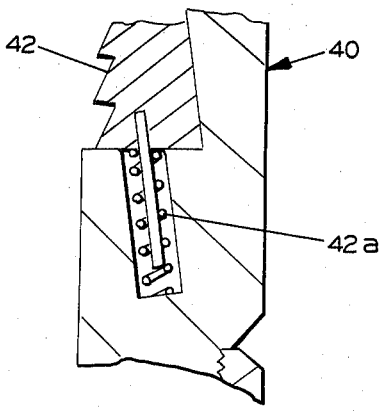
FIG. 3*a* comprises an enlarged scale sectional view of a portion of a slip element of the hanger apparatus shown in FIG. 3.
Figure 3:
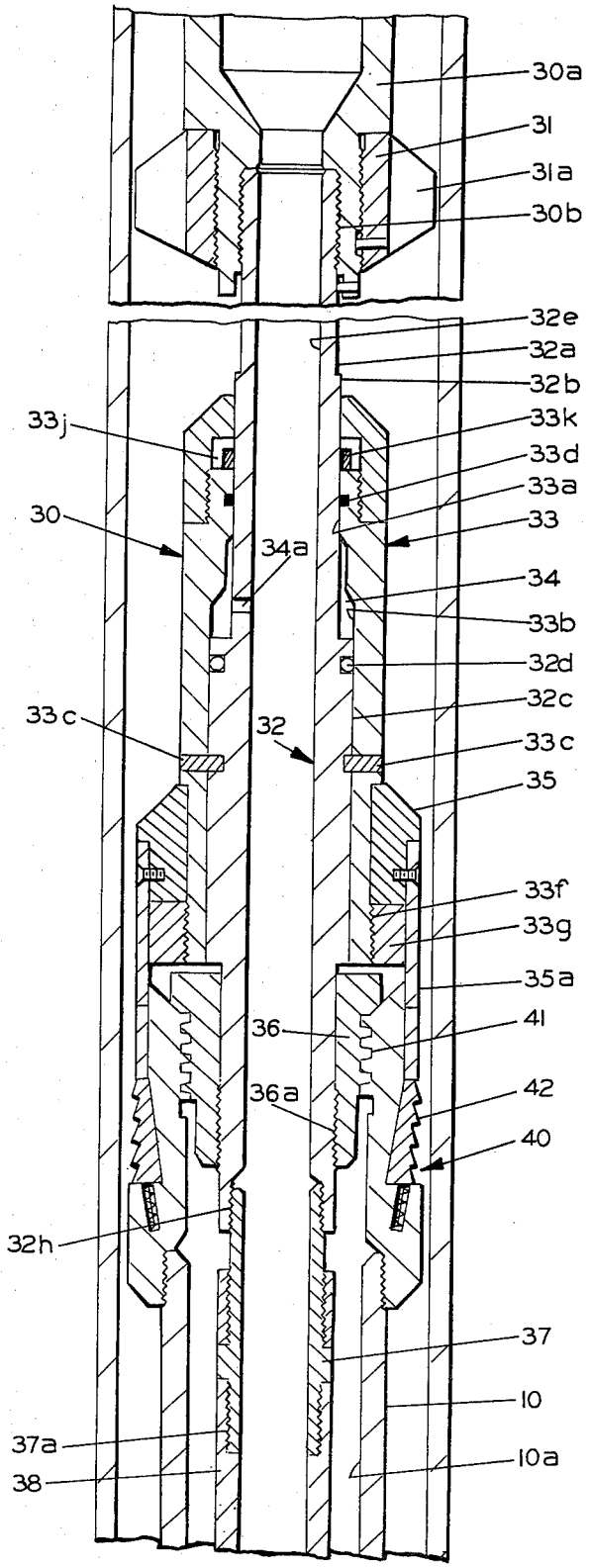
FIG 3 comprises an enlarged scale view of the hanger portion of the apparatus of FIG. 1.

Referring now to the enlarged scale drawing of FIG. 3, the running tool 30 comprises a top sub 30a, secured to threads 22b of expansion joint 20 to which is threadably secured a conventional gauge ring 31 having radially projecting flanges 31a to center the apparatus within the well casing 2 as it is lowered into the well. The lower end of top sub 30a is secured by threads 30b to the top end 32a of a central body sleeve 32 which extends the entire length of the running tool 30. Adjacent its upper portion, the body portion 32 is provided with a radially enlarged bearing surface 32b with which the internal bore surface 33a of an annular piston assembly 33 slidably and sealably cooperates. The seal is provided by an O-ring 33d in the piston assembly 33.

A fluid pressure chamber 34 is defined between an internal annular surface 33b of the piston assembly 33 and the bearing portion 32b of body sleeve 32. Internal surface 33b of piston assemblage 33 slidably and sealably cooperates with a further enlarged bearing portion 32c formed on the body sleeve 32. An O-ring seal 32d provides sealing between such cooperating sliding surfaces.

A radial port 34a extends from chamber 34 into communication with the bore 32e of the body sleeve portion 32 of running tool 30. Thus, when fluid pressure is applied to the chamber 34 by increasing the pressure in the bore 32e, the annular piston assembly 33 will tend to move upwardly and this upward movement is utilized to effect the hydraulic setting of the hanger 40. In the run-in position of the piston 33, it is secured against any axial movement by one or more shear pins 33c which engage the enlarged bearing portion 32c of the central body sleeve 32. The shear pins 33c are, of course, shearable through the application of a predetermined fluid pressure to the pressure chamber 34.

Figure 4:
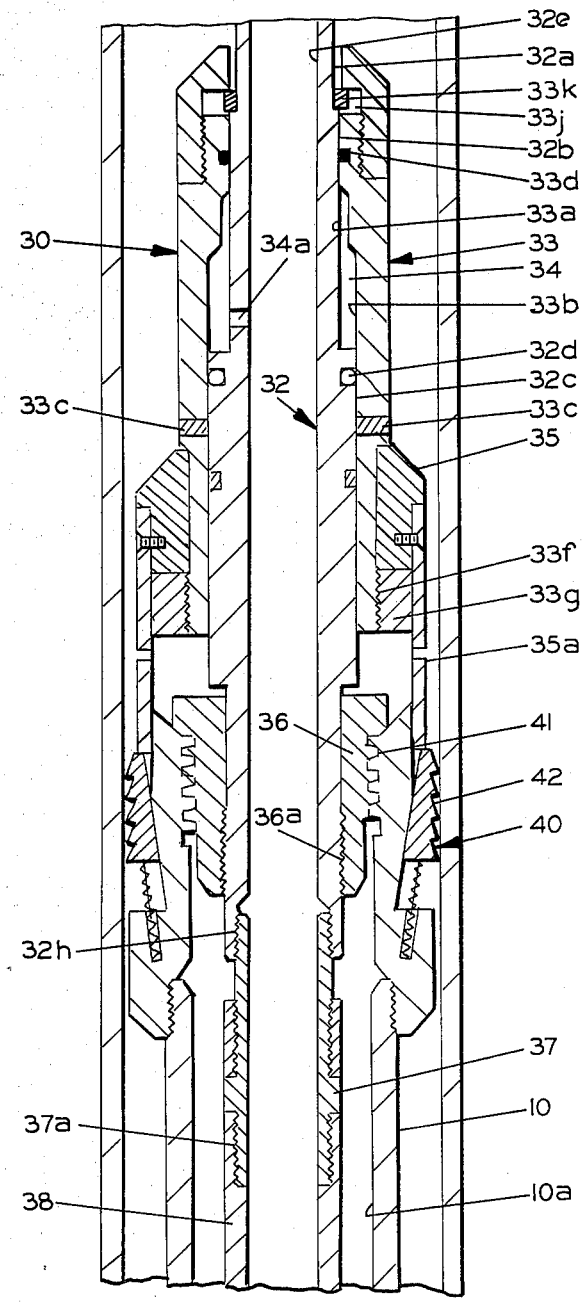
FIG. 4 is a view similar to FIG. 3, but showing the hanger in its set position.

The lowermost portion of the annular piston assembly 33 is provided with threads 33f and a retaining ring 33g is secured thereto. Retaining ring 33g secures a finger ring 35 against axial displacement relative to the annular piston assembly 33 but does not interfere with relative rotational movement of the piston 33 with respect to the finger ring 35. The finger ring 35 is provided with a plurality of peripherally spaced, downwardly extending fingers 35a which respectively cooperate with spring pressed slips 42 of the hanger 40 to retain such slips in their radially retracted position during the run-in of the apparatus. Springs 42a (FIG. 3a) provide an axial and outward bias to the slips 42 urging them to a setting position in engagement with the wall of casing 2 when the axial restraint imposed by the fingers 35a is removed (FIG. 4).

As previously mentioned, hanger 40 is provided with a set of internal left hand square threads 41 by which the hanger is suspended from the body sleeve 32 of the running tool 30. The cooperating external thread on the body sleeve 32 are formed on a sleeve 36 which is secured to the body sleeve 32 by threads 36a.

The bottom end of body sleeve 32 of running in tool 30 is internally threaded as indicated at 32h and secured by such threads to a conventional swivel sub 37, which may, for example, comprise Bakerline Swivel Sub Product No. 260-35, manufactured and sold by Bakerline. The swivel sub 37 terminates in a male threaded portion 37a to which is secured an extension sleeve 38 on the bottom end of which is shearably mounted an annular liner wiper plug 39 (FIG. 1). Wiper plug 39 may, for example, comprise Bakerline Wiper Plug Product No. 260-52, manufactured and sold by Bakerline. It embodies an annular body portion 39a and radially projecting resilient flange portions 39b which effect a wiping action of the interior bore 10a of the liner assembly 10 whenever the shear elements (not shown) securing such plug to the sleeve 38 are sheared through the application of a downward force to such plug 39 in a manner to be hereinafter described.

Figure 2:
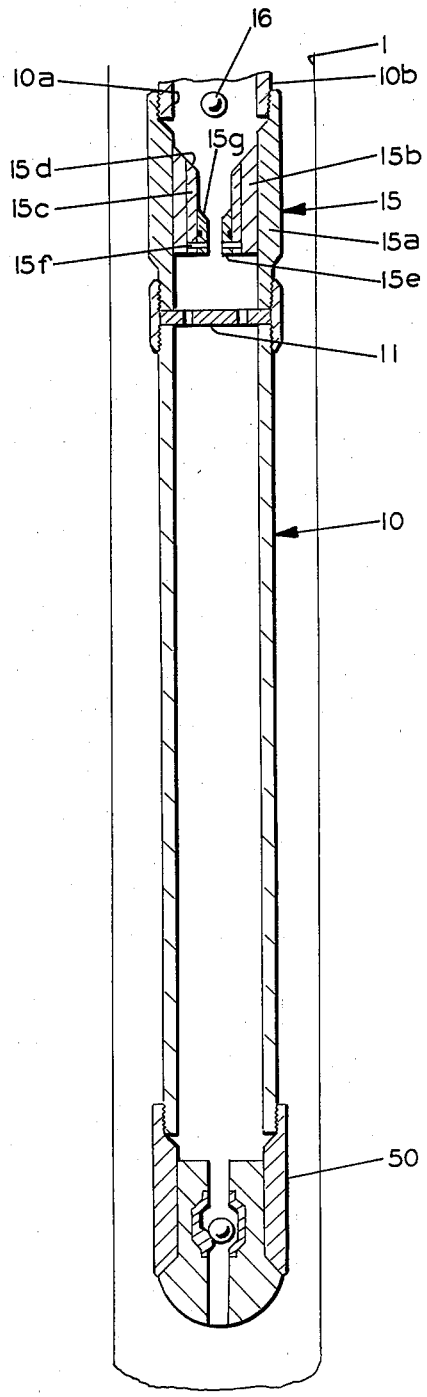

As previously mentioned, the upper portion 10b of the liner sleeve assembly 10 is threadably secured to a conventional landing collar 15. Landing collar 15 includes a sleeve body portion 15a threaded at opposite ends, and an inner annular layer of cementitous material 15b supporting a sleeve 15c. The top surfaces of annular layer 15b and sleeve 15c define a conical sealing surface 15d. Additionally, a valve seat defining sleeve 15e is mounted witin the bore of sleeve 15c and retained thereon by shear pins 15f. Second sleeve 15e has a conical valve seating surface 15g on its upper end adapted to receive a ball 16 of bronze or similar material in sealing relationship when such ball is dropped through the aligned bores of the tubular work string 3, the expansion joint 20 and the running tool 30. The dropping of such ball 16 (FIG. 2) permits the fluid pressure within the bore 32e of the body sleeve 32 of the running tool 30 to be increased to a first level permitting the shearing of the shear screws 33c which releases the annular piston assembly 33 for upward movement under the influence of such fluid pressure, thereby releasing the slips 42 for axially upward and outward movement into setting engagement with the wall of casing 2 (FIG. 4).

Referring to FIG. 3, at a point above the upper O-ring 33d, the internal surface 33a of the annular piston assembly 33 is provided with an annular recess 33j to accommodate an expanded resilient C-ring 33k, which snugly engages the bearing surface 32b of the body portion 32 of the running tool 30. When the piston has been elevated to a desired position wherein the slips 42 of the hanger 40 are completely released, the C-ring 33k snaps into engagement with the smaller diameter upper portion 32a of the body sleeve 32 (FIG. 4) and thus secures the piston assembly 33 in its elevated position, thereby eliminating any possible future interference of the piston assembly with the slips 42 of the hanger 40.

Since no cementing fluid could be applied to the lower portions of the liner sleeve assembly 10 so long as the ball 16 is in place, the shear screws 15f are selected to have a shear strength permitting the shearing thereof when the fluid pressure is increased to a level substantially above that required to effect the upward movement of the piston assembly 33. When the shear screws 15f shear, the inner valve seat sleeve 15e and the ball 16 will be dropped down through the bore of the liner sleeve assembly 10 and could possibly block the passage of cementing fluid through the cement float shoe 50. For this reason, the liner sleeve assembly 10 preferably incorporates a perforated trash collecting plate 11 located at a position below in landing collar sleeve 15 to catch the sheared ball seat sleeve 15*e* and ball 16, in the manner indicated in FIG. 10, without interfering with the flow of cementing fluid down through the bore of the liner sleeve assembly 10.

Figure 11:
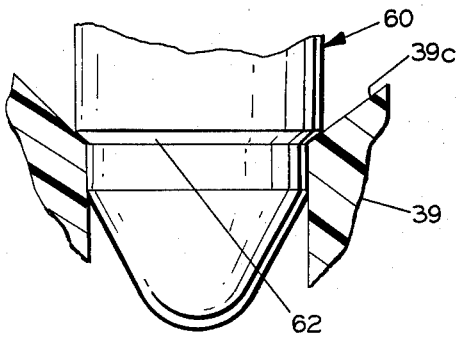
FIG. 11 is an enlarged scale view of a portion of FIG. 10.
Figure 9:
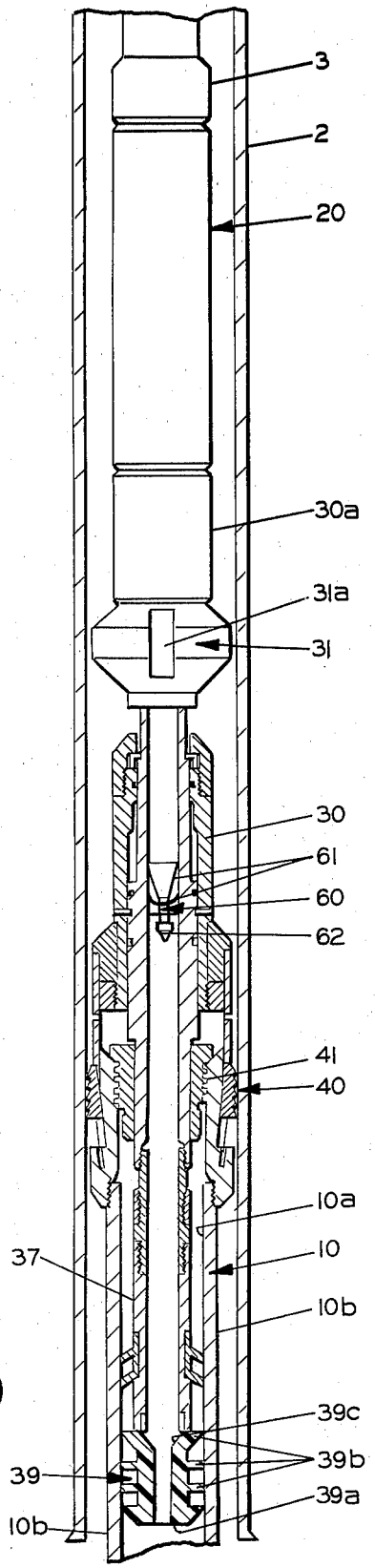
FIG. 9 is a view similar to FIG. 1 but showing the hanger in its set position and a wiper plug traversing the bore of the running tool.
Figure 10:
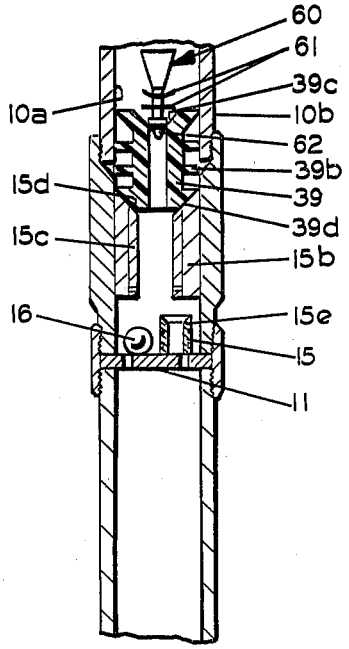
FIG. 10 is a view similar to FIG. 8 but illustrating the final seating of the wiping tools after the completion of the cementing operation.
Figure 8:
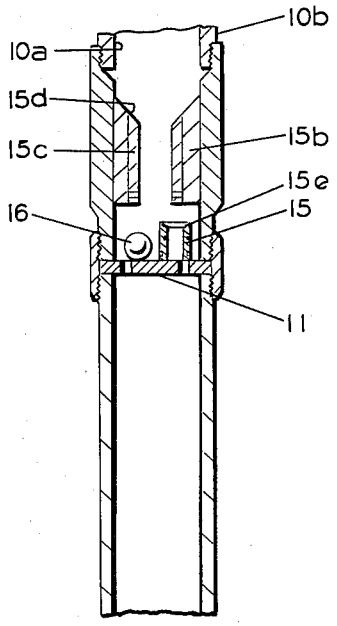
FIG. 8 is a view of a portion of FIG. 2, shown after the shearing of the ball seat sleeve.

Lastly, and referring particularly to FIGS. 9–11, a solid elastomeric wiping plug 60 is provided, which is inserted into the bore of the tubular work string after the introduction of the required amount of cementing fluid. Wiping plug 60 is provided with radially projecting, inclined elastic flanges 61 which are dimensioned so as to effect a wiping action with all of the interior bore surfaces of the work string 3, the expansion joint 20, and the bore 32*e* of the running tool 30, to wipe any residual cementing fluid off such surfaces.

As illustrated in FIG. 10, when the solid wiping plug 60 is pushed by fluid pressure down through the bottom of the running tool 30, it will contact the annular wiping plug 39 and the bottom surface 62 of the solid wiping plug 60 effects a sealed engagement with the conical upwardly facing surface 39*c* of the annular wiping plug 39 (FIG. 11). The fluid pressure applied behind the solid wiping plug 60 to force it down through the interconnected bores is increased to a level to effect the shearing of the retaining shears (not shown) for the annular wiping plug 39 and moves the two wiping elements concurrently down through the bore 10*b* of the upper portion 10*a* of the line sleeve assembly 10 until the bottom conical surface 39*d* of the annular wiping plug 39 seats on the sealing surface 15*d* provided in the landing collar sleeve 15 (FIG. 10).

From the foregoing description, the operation of the described apparatus will be readily apparent to those skilled in the art. During run-in of the described apparatus, the expansion joint 20 is extended by the weight of the liner hanger and running tool. After running in of the assembled apparatus, the operator has the choice of effecting the setting of the hanger 40 either before or after the liner cementing operation. Assuming that he elects to set the hanger 40 prior to the liner cementing operation, the ball valve 16 is then dropped through the work string 3 to seat on the upwardly facing conical surface 15*e* provided in the landing collar sleeve 15. The fluid pressure within the interconnected bores may then be increased to a level to cause the piston assembly 33 to shear the shear screws 33*c* and move upwardly, thus moving the retaining fingers 35*a* upwardly and releasing the spring pressed slips 42 into setting engagement with the interior wall of casing 2 (FIG. 4).

The fluid pressure is then increased to a level which produces the shearing of the shear screws 15*f*, thus permitting the valve seat sleeve 15*e* in the landing collar sleeve 15 and the ball 16 to drop downwardly and be caught by the perforated trash collecting plate 11 provided in the liner sleeve assembly 10. Cementing fluid may then be introduced through the tubular work string 3 and such fluid will pass freely downwardly through the interconnected bores of the expansion joint 20, the running tool 30 and the bore 10*a* of the liner sleeve assembly 10, passing through a ball valve conventionally provided in the cement float shoe 50 and then outwardly around the liner sleeve assembly 10 to fill in the space between the liner sleeve assembly 10 and the well bore 1.

When the desired quantity of cementing fluid has been introduced into the well, the solid wiping plug 60 is introduced into the top of the tubular work string and pumped downwardly through the work string and the interconnected bores of the cementing apparatus through the application of a suitable pressured fluid, such as drilling mud. As such plug 60 passes downwardly, it achieves a wiping of all of the interior surfaces of the interconnected bores. As previously mentioned, it seats on the upwardly facing conical surface 39*c* of the annular wiping element 39 and effects the shearing of the retaining means (not shown) holding wiping element 39 onto the bottom of sleeve 38. The wiping element 39 is then forced downwardly by the fluid pressure and achieves a wiping of the interior bore surfaces 10*a* of the liner 10 until it seats on the upwardly facing sealing surface 15*d* provided in the landing collar sleeve 15 (FIG. 11).

The running tool 30 may be readily released from the set hanger 40 by rotation of the tubular work string 3 in a clockwise direction. This effects the disengagement of the left hand square threads 41 and the release of the running tool 30 from the hanger 40. The axial movement is absorbed by expansion joint 20.

The aforedescribed cementing apparatus may be run in the well and, instead of dropping the ball valve 16 to close off the interconnected bores of the apparatus, the cementing fluid is introduced into the work string and flows downwardly through the interconnected bores. Since there are no obstructions in its path, it flows directly into the bore 10*a* of the liner sleeve assembly 10 and then outwardly through the cement float shoe 50 into the space between the well bore 1 and the outer periphery of the liner sleeve assembly 10. After the desired amount of cementing fluid has been passed into the well, the solid wiper plug 60 is introduced into the top of the tubular work string and urged downwardly by suitable fluid pressure. The wiper plug performs the same function as heretofore described, and engages the annular wiper plug 39 and effects the shearing of the retaining means for such annular plug. The two plugs then move downwardly through the bore 10*a* of the liner sleeve assembly 10, wiping such bore as it moves downwardly, until the annular wiping sleeve 39 is arrested by sealing engagement with the conical surface 15*d* of the valve seat sleeve 15*c* of the landing collar 15 (FIG. 11). Since the solid plug 60 is in sealing engagement with the upwardly facing conical surface 39*c* of the annular wiping plug 39, it will be apparent that the interconnecting bores of the cementing apparatus are now effectively sealed by the combined wiping plugs. At this point, the fluid pressure may be raised to a level sufficient to effect the shearing of shear pins 33*c*, thus permitting the annular piston assembly 33 to raise fingers 35*a* and release the spring pressed slips 42 for setting engagement with the wall of casing 2.

After setting the hanger 40, a clockwise rotation of the tubular work string 3 will effect the release of the running tool 30 from the hanger 40 by virtue of the action of the left hand threads 41. The upward movement of running tool 30 is absorbed by expansion joint 20.

The aforedescribed apparatus has the further advantage in the event that, for some unforeseen reason, the hydraulic setting of the hanger 40 will not properly function, nevertheless, the hanger 40 may be set by mechanical manipulation. In such case, if the cementing operation has not been performed, the entire assembly is lowered to set the bottom end of the liner sleeve assembly 10 into engagement with the bottom of the well bore 1 and then the work string 3 is rotated in a clockwise direction to effect the release of the running tool 30 from the hanger 42 and at the same time elevate the retaining fingers 35*a* with respect to the spring pressed slips 42 to permit the setting operation to be accomplished. [It is for this reason that it is important that the slip retaining fingers 35*a* be freely rotatable relative to the balance of the running in tool 30 and this rotative freedom is provided by a finger ring 35 which mounts the retaining fingers 35*a*.]The upward movement of the running tool 30 is absorbed by the torque transmitting expansion joint 20.

It should also be noted that the design of the expansion joint 20 is uniquely suitable for use in this cementing apparatus. Not only will the expansion joint 20 transmit the required torque from the work string 3 to effect the release of the running in tool 30 from the hanger 40, or even the mechanical setting of the hanger 40, and absorb the upward movement of running tool 30, but additionally, the interior surfaces of the two sleeve assemblages 21 and 22, particularly tapered shoulders 21*g* and 24*d*, are designed to permit them to be cleanly wiped by the resilient flanges 61 of the solid wiping plug 60.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. Appartus for cementing a liner in the bottom of a subterranean well bore below the well casing comprising, in combination: a torque transmitting, annular expansion joint having its upper end adapted to be secured to a tubular work string; an annular running tool secured to the bottom end of said torque transmitting, annular expansion joint, said running tool and said expansion joint defining interconnected axial bores having substantially the same I.D. as the tubular work string; a liner hanger secured in surrounding relationship to said running tools by left hand threads; a liner sleeve assembly having its top end secured to the lower portion of said liner hanger; said liner sleeve assembly including means for attaching a cement float shoe at its bottom end and a landing collar sleeve disposed above the cement float shoe; shearable valve means in said landing collar permitting the development of a predetermined fluid pressure in the bore of said running tool; said liner hanger having a plurality of slips disposed around its exterior periphery and movable outwardly to engage the well casing; resilient means urging said slips outwardly; axially movable means on said running tool retaining said slips in an inwardly retracted position during run-in of the aforesaid apparatus; an annular piston formed on said axially movable means, said running tool defining an annular cylinder chamber cooperable with said annular piston and in fluid communication with said bore of said running tool, whereby the application of a predetermined fluid pressure to the tubular work string effects displacement of said piston to release said slips to expand into engagement with the well casing and set the hanger; said axially movable means including a ring axially fixed on said axially movable means but rotatable relative thereto; a plurality of axial fingers secured to said ring and respectively engagable with said slips, whereby right hand rotation of said running tool relative to said liner sleeve assembly will alternatively release said slips and set the hanger and permit removal of the running tool; said shearable valve means being sheared and displaced downwardly in the liner by an increase of fluid pressure above said predetermined value, thereby permitting flow of cementing fluid into said liner.

2. Apparatus for cementing a liner in the bottom of a subterranean well bore below the well casing, comprising, in combination: a torque transmitting, annular expansion joint having its upper end adapted to be secured to a tubular work string; an annular running tool secured to the bottom end of said annular expansion joint, said expansion joint and said running tool defining interconnected axial bores having substantially the same I.D. as the tubular work string; a liner hanger secured in surrounding relationship to said annular running tool by left hand threads; a liner sleeve assembly having its top end secured to the lower portion of said hanger; said liner sleeve assembly including means for attaching a cement float shoe at its bottom end and a landing collar sleeve disposed above the cement float shoe; said liner hanger having a plurality of slips disposed around its exterior periphery and movable outwardly to engage the well casing; resilient means urging said slips outwardly; axially movable means on said running tool retaining said slips in an inwardly retracted position during run-in of the aforesaid apparatus; an annular piston formed on said axially movable means, said running tool defining an annular cylinder chamber cooperable with said annular piston and in fluid communication with said running tool bore, whereby the application of fluid pressure to the interconnected bores effects displacement of said piston to release said slips and expand into engagement with the well casing and set the hanger; said axially movable means including a ring axially fixed on said axially movable means but rotatable relative thereto; a plurality of axial fingers secured to said ring and respectively engagable with said slips, whereby right hand rotation of said running tool relative to said liner sleeve assembly will alternatively release said slips and set the hanger and permit removal of the running tool; a solid wiper plug having resilient, radially projecting wiper flanges snugly engaging the said interconnected axial bores and pushed by fluid pressure therethrough to wipe cement off the said interconnected bore surfaces after a desired quantity of fluid cement has been supplied to said liner sleeve assembly through the tubular work string and the interconnected bores; a downwardly extending tubular element secured to said running tool and defining a continuation of said interconnected bores; and an annular wiper plug shearably secure to said tubular element and having radially projecting, resilient wiping elements engagable with the inner bore of said liner sleeve assemblage above said landing collar, said annular wiper plug having an upwardly facing surface cooperating with the bottom end of said solid wiper plug whereby the downward movement of said solid wiper plug shears said annular wiper plug from said tubular element and moves said annular wiper plug down the liner bore to engage and seal on said landing collar.

3. The apparatus defined in claim 1 or 2 wherein shearable means hold said axially movable means in its slip retaining position.

4. Apparatus defined in claim 1 or 2 wherein said torque transmitting expansion joint comprises an inner sleeve assembly slidably telescoped within an outer sleeve assembly for limited reciprocal axial movements; sealing means disposed between the sleeve assemblies; one of said sleeve assemblies defining internal splines and the other sleeve assembly defining external splines slidably co-operable with said internal splines to permit transmission of torque through said expansion joint; and threaded means respectively on the outboard ends of said sleeve assemblies for respective connection to the tubular work string and said running tool.

5. The apparatus of claim 1 or 2 wherein all portions of the axial bore defined by said inner and outer sleeve assemblies in all relative axial positions is not greater than the maximum diameter of said solid wiper plug flanges, thereby preventing retention of cementing fluid in said expansion joint.

* * * * *